US007605692B2

(12) United States Patent
Yamada et al.

(10) Patent No.: US 7,605,692 B2
(45) **Date of Patent: *Oct. 20, 2009**

(54) INDICATOR CONTROL SYSTEM WITH CAMERA SECTION

(75) Inventors: Hideo Yamada, Tokyo (JP); Isao Murota, Tokyo (JP); Tomoaki Ono, Tokyo (JP); Satoshi Fujii, Tokyo (JP)

(73) Assignee: Caterpillar Japan Ltd., Tokyo (JP)

( * ) Notice: Subject to any disclaimer, the term of this patent is extended or adjusted under 35 U.S.C. 154(b) by 412 days.

This patent is subject to a terminal disclaimer.

(21) Appl. No.: 10/584,112

(22) PCT Filed: Dec. 16, 2004

(86) PCT No.: PCT/JP2004/018805

§ 371 (c)(1),
(2), (4) Date: Jun. 23, 2006

(87) PCT Pub. No.: WO2005/064092

PCT Pub. Date: Jul. 14, 2005

(65) Prior Publication Data

US 2007/0120660 A1 May 31, 2007

(30) Foreign Application Priority Data

Dec. 25, 2003 (JP) ..... 2003-431633

(51) Int. Cl.

| | |
|---|---|
| ***B60Q 1/00*** | (2006.01) |
| *G09F 9/00* | (2006.01) |
| *G05D 1/02* | (2006.01) |
| *H04N 7/18* | (2006.01) |

(52) U.S. Cl. ..... 340/438; 340/461; 340/439; 340/425.5; 37/348; 348/148

(58) Field of Classification Search ..... 340/438, 340/461, 439, 425.5
See application file for complete search history.

(56) References Cited

U.S. PATENT DOCUMENTS 5,838,250 A * 11/1998 Maekawa ..... 348/143
6,778,097 B1 * 8/2004 Kajita et al. ..... 340/825.69

(Continued)

FOREIGN PATENT DOCUMENTS

EP 0976879 B1 * 2/1998

(Continued)

OTHER PUBLICATIONS

PCT/JP2004/018805 International Search Report; Mar. 22, 2005.

(Continued)

*Primary Examiner*—Daniel Wu
*Assistant Examiner*—Jack Wang
(74) *Attorney, Agent, or Firm*—Duane Morris LLP

(57) ABSTRACT

An indicator control system with a camera section provided with a switch for switching from a measurement value display mode to a camera display mode and vice versa to display a selected mode on a monitor section of an indicator. The measurement value display mode shows the measurement data of an object to be monitored on a construction machine, and the camera display mode is for the camera section mounted on the construction machine.

10 Claims, 6 Drawing Sheets

U.S. PATENT DOCUMENTS

| | | | | |
|---|---|---|---|---|
| 2002/0191078 | A1* | 12/2002 | Okamoto et al. | 348/148 |
| 2003/0000115 | A1* | 1/2003 | Green et al. | 37/348 |
| 2003/0226290 | A1* | 12/2003 | Savard et al. | 37/348 |
| 2004/0017929 | A1* | 1/2004 | Bramblet et al. | 382/103 |
| 2004/0198254 | A1* | 10/2004 | Mizui et al. | 455/99 |
| 2005/0080528 | A1* | 4/2005 | Obradovich | 701/36 |
| 2005/0104322 | A1* | 5/2005 | Swannie | 280/432 |

FOREIGN PATENT DOCUMENTS

| | | |
|---|---|---|
| JP | 64059380 | 3/1989 |
| JP | 05156665 | 6/1993 |
| JP | 11217853 | 8/1999 |
| JP | 11286971 | 10/1999 |
| JP | 2001320624 | 11/2001 |
| JP | 2002021121 | 1/2002 |
| JP | 2002294762 | 10/2002 |
| JP | 2002301953 | 10/2002 |
| JP | 2002371594 | 12/2002 |
| JP | 2004-308137 | 11/2004 |

OTHER PUBLICATIONS

PCT/JP2004/018805 IPRP (English Translation); Unknown.

* cited by examiner

INDICATOR CONTROL SYSTEM WITH CAMERA SECTION

TECHNICAL FIELD

The present invention relates to an improvement of an indicator control system having a camera section for switching from a measurement value display mode to a camera display mode and vice versa to display a selected mode on a monitor section of an indicator, the measurement value display mode showing the measurement data of an object to be monitored of a construction machine, and the camera display mode being for the camera section mounted on the construction machine.

BACKGROUND ART

In the case where a monitoring camera is used as an auxiliary means for performing work using a construction machine safely and smoothly, it is necessary to provide a display for showing the image of the camera in a driver's cabin (for example, Japanese Patent Provisional Publication No. 2002-294762).

On the other hand, for an indicator of the construction machine, especially a hydraulic excavator, not only fuel and engine cooling water but also the temperature of hydraulic oil for driving the excavator must be monitored, and these measurement values are shown on a gage or a liquid crystal display of the indicator.

However, the space of the driver's cabin is limited, so that a problem arises in that a display for showing camera images provided separately from the gage and the indicator obstructs the front field of vision.

Also, even in the case where alarm information is shown on a separate monitor for monitoring the equipment information, a problem arises in that it is difficult for the operator to become aware of the alarm information when he/she is paying attention to the display for camera.

Accordingly, Japanese Patent Provisional Publication No. 2002-371594 has disclosed a configuration in which switching from a first mode for showing an image from a rear monitoring camera on a single monitor screen to a second mode for showing a vehicle body state on the monitor screen and vice versa can be performed, and this switching operation is performed by the operation of a running operation means, by which the monitor screen is used in common.

However, conventionally, the rear monitoring camera has been operated by the operation of a running lever, and a method for monitoring the directions other than the rear has not been developed, so that the camera has poor flexibility.

Also, the camera has been fixed, and the movement of photographing position has not been thought, which poses a drawback in that the monitoring area is limited.

Patent Document 1: Japanese Patent Provisional Publication No. 2002-371594 Refer to FIG. 4

DISCLOSURE OF THE INVENTION

Problems to be Solved by the Invention

A problem to be solved by the present invention is to provide an indicator control system with a camera section, in which a monitor section of an indicator can be switched from a measurement value display mode for showing the measurement data of an object to be monitored of the construction machine to a camera display mode for showing an image picked up by a camera and vice versa, and switching can be performed by the operation of a switch or an operation member, which serves as a switching means.

Another problem to be solved by the present invention is to provide an indicator control system with a camera section characterized in that the photographing posture of the camera section can be controlled remotely by using a switch of the indicator.

MEANS FOR SOLVING THE PROBLEMS

To solve the above problem, the present invention provides an indicator control system with a camera section, which switches from a measurement value display mode for showing measurement data of an object to be monitored of a construction machine to a camera display mode of a camera section mounted on the construction machine and vice versa by using a switching means and displays a selected mode on a monitor section, characterized in that the switching means consists of a switching means consisting of any one or a combination of two or three of manual switching using an input means such as a predetermined switch provided near an operator's seat or on an indicator, automatic switching effected by the detection of a previously registered operation of a predetermined operation member, and automatic switching effected when an indicator alarm judging means judges that the display of an alarm screen is necessary.

The switching means may consist of manual switching using an input means such as a predetermined switch provided near an operator's seat or on an indicator, automatic switching effected by the detection of a previously registered operation of a predetermined operation member, and automatic switching effected when an indicator alarm judging means judges that the display of an alarm screen is necessary.

Also, the construction may be such that the camera section can be attached to a desired position of the construction machine; when the camera section is arranged to monitor the rear of the construction machine, the current display mode on the monitor section is switched by the detection of operation of a running operation member; when the camera section is arranged to monitor the side of the construction machine, the current display mode on the monitor section is switched by the detection of operation of a swirl operation member; and when the camera section is arranged to monitor the front of the construction machine, the current display mode on the monitor section is switched by the detection of operation of a operation member for boom, arm, or bucket.

The detection of the kind of the operation member serving as the switching means and a combination of operations can preferably be changeably registered in the memory.

Also, the camera section may be provided with a camera control unit which changes the camera posture such as the photographing direction of the camera section and controls the focusing mechanism for a zoom lens of a camera; and the indicator may be provided with a camera control input means for sending a control signal to the camera control unit.

Further, the camera control input means may consist of manual input using an input means such as a predetermined switch provided on the indicator, or automatic input effected by the detection of a previously registered operation of a predetermined operation member carried out by the whole or a part of the camera control input means.

EFFECT OF THE INVENTION

In the indicator control system with a camera section in accordance with the present invention, since the measurement value display mode and the camera display mode can be displayed on one indicator by being switched, the space in a cab can be saved, and also good front visibility can be secured.

Also, the display mode can be switched smoothly by the operation of a switch provided on the indicator or an operation member.

Further, since the camera section can carry out control such as the control of the photographing direction or the control of zooming in and out by a remote control switch provided on the indicator, the monitoring area can be made variable or the image can be enlarged, which contributes to safety.

EXPLANATION OF SYMBOLS

Figure 1:
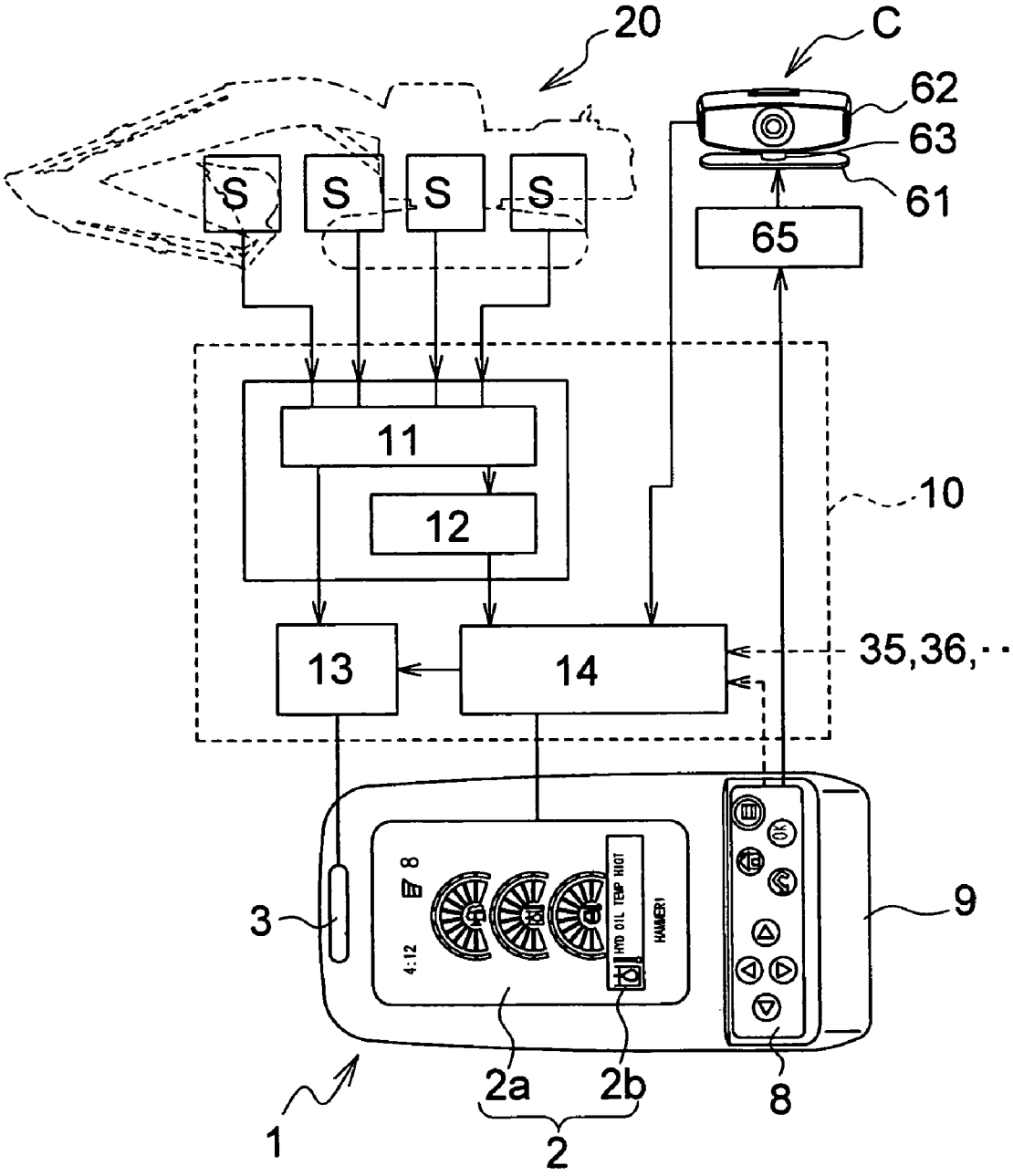
FIG. 1 is a block diagram of an indicator control system with a camera section in accordance with example 1.

1 . . . indicator
2 . . . monitor section
2*a* . . . gage image display section
2*b* . . . event display section
3 . . . alarm section
4 . . . fuel gage
5 . . . oil temperature gage
6 . . . water temperature gage
8 . . . control panel section
10 . . . controller
11 . . . alarm judging means
11' . . . camera alarm judging means
12 . . . image processing means
13 . . . alarm control means
14 . . . input switching means
20 . . . hydraulic excavator
35 . . . running control lever
36 . . . work equipment control lever
65 . . . camera control unit
70 . . . camera control input section
C . . . camera section
S . . . sensor
S1 . . . screen selector switch

BEST MODE FOR CARRYING OUT THE INVENTION

A preferred embodiment in the case where an indicator control system with a camera section in accordance with the present invention is applied to a hydraulic excavator will now be described with reference to the accompanying drawings.

Example 1

An indicator control system with a camera section shown in FIG. 1 includes an indicator 1 provided in a cab, a sensor group S, S, S . . . which is provided on predetermined components of a hydraulic excavator 20 to obtain measurement data, a monitoring camera C mounted at a predetermined location of the hydraulic excavator 20, and a controller 10 which allows images to be displayed in a monitor section 2 of the indicator 1 based on the measurement data to control the activation of an alarm section 3.

In the case of this example, the controller 10 includes an alarm judging means 11 for judging whether or not the measurement data from the sensor group S, S, S . . . corresponds to a preset alarm standard (in other words, whether or not the measurement data is included in the normal region), an image processing means 12 for converting the measurement data into a gage image, an alarm control means 13 for determining a pattern control of alarm to the alarm section 3, and an input switching means 14 for determining an image input to the monitor section 2 (and also for sending the determined display mode to the alarm control means).

[Hydraulic Excavator]

Figure 2:
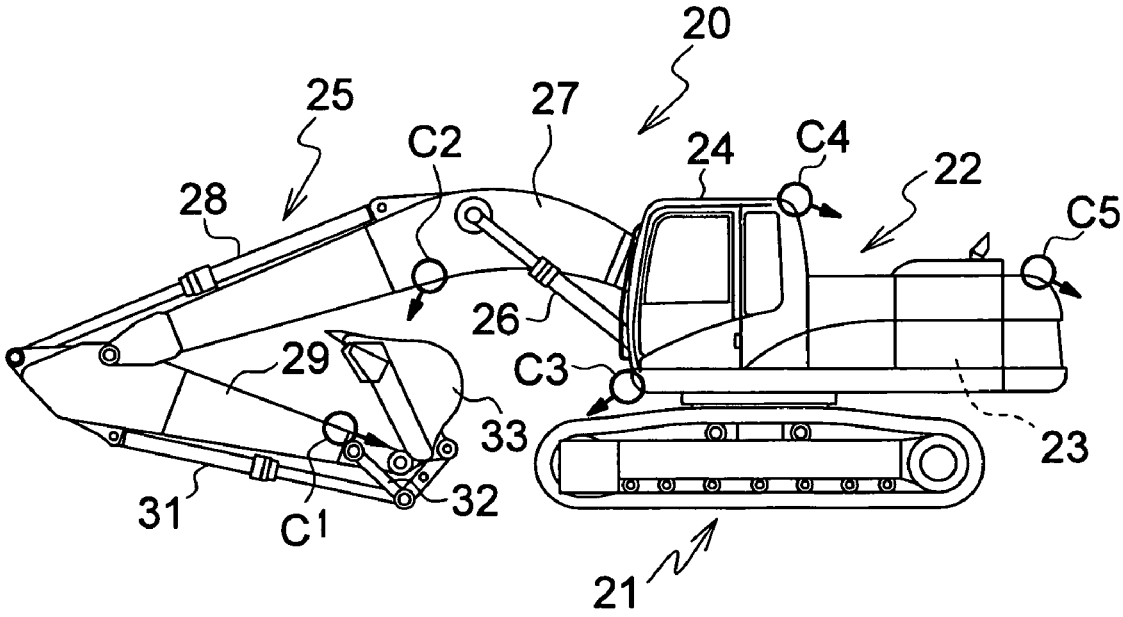
FIG. 2 is a side view showing one example of an installation position of a camera section of a hydraulic excavator.

A general configuration of the hydraulic excavator 20, which is shown as one example of work equipment, is shown in FIG. 2.

The hydraulic excavator 20 has a general configuration in which an upper swinging body 22 is provided on a lower running body 21 so as to be capable of swinging, and the upper swinging body 22 is mounted with a power system section 23 including an engine, a hydraulic pump driven by the engine, and the like, a hydraulic control section, not shown, for controlling a hydraulic circuit connected to the hydraulic pump, a cab 24 serving as an operator's room, and a work attachment 25.

For the work attachment 25, in a tip end portion of a boom 27 turned by a hydraulic cylinder 26 for boom, an arm 29 turned by a hydraulic cylinder 28 for arm is pivotally supported, and in a tip end portion of the arm 29, a bucket 33 turned by a hydraulic cylinder 31 for bucket via a linkage 32 is pivotally supported.

[Indicator]

Figure 3:
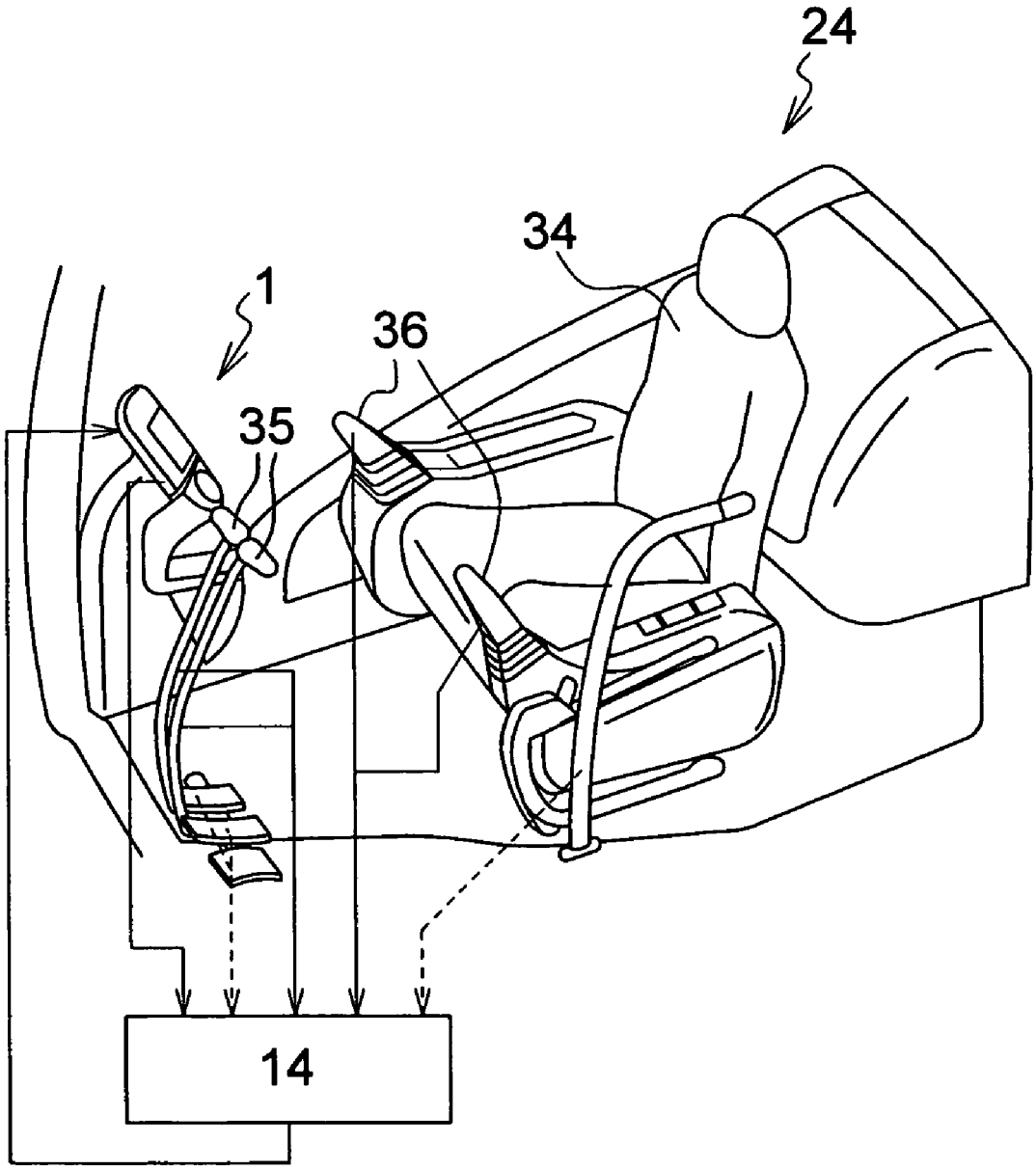
FIG. 3 is an explanatory view of switching of inputs to a monitor section by using a control lever.

The indicator 1 is disposed at an appropriate location in the cab 24; in one example shown in FIG. 3, it is disposed at one side of running control levers 35 which are provided in front of a seat 34.

Figure 4:
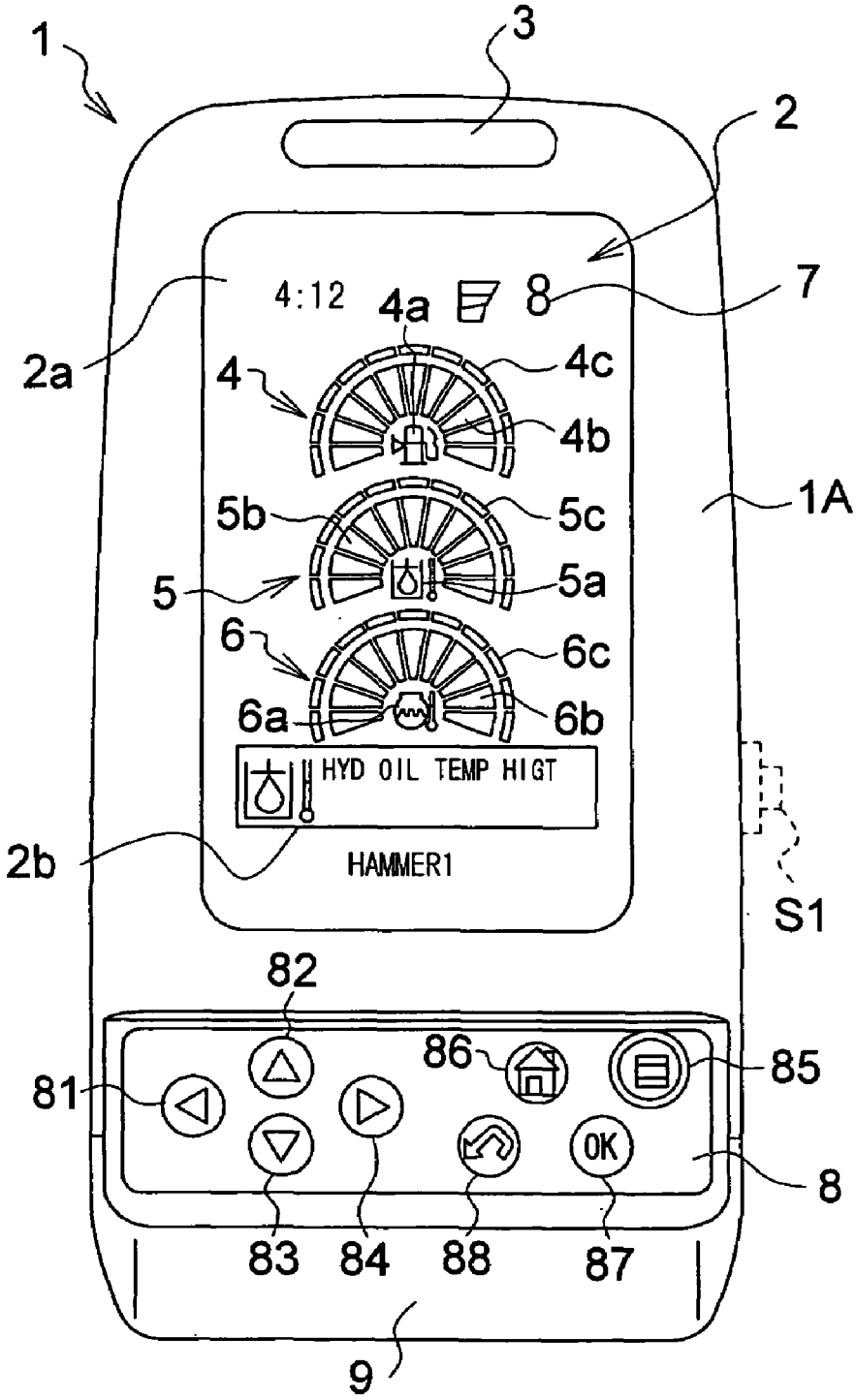
FIG. 4 is a front view of an indicator.

In this example, as shown in FIGS. 1 and 4, the indicator 1 is configured so that the alarm section 3 consisting of a red lamp incorporating an LED is provided at an upper part of a housing 1A, the liquid crystal monitor section 2 is formed in the center thereof, and a control panel section 8 is provided at a lower part thereof.

The alarm section 3 generates an alarm by turning on or turning on and off the light source such as an LED according to a predetermined alarm pattern.

[Monitor Section]

In the case of the example shown in the figures, the monitor section 2 is a liquid crystal screen provided with a gage image display section 2*a* for showing the measurement values of objects to be monitored, such as a fuel gage 4 for showing the remaining amount of engine fuel, an oil temperature gage 5 for showing the oil temperature of hydraulic oil in the hydraulic circuit, a water temperature gage 6 for showing water temperature of engine cooling water, and the like; a character display section 7 for showing numerical values and the like; and an event display section 2*b* for showing alarm contents and various pieces of equipment information with icons and characters. The fuel gage 4, the oil temperature gage 5, and the water temperature gage 6 each consist of a full-graphic liquid crystal display using a liquid crystal/LED (Light Emitting Diode).

The fuel gage 4, the oil temperature gage 5, and the water temperature gage 6 each include a symbol icon 4*a*, 5*a*, 6*a*, a display section 4*b*, 5*b*, 6*b* arranged so as to surround the symbol icon 4*a*, 5*a*, 6*a* to graphically show a real-time measurement value (remaining fuel amount, water temperature, oil temperature), and an alarm region display section 4*c*, 5*c*, 6*c* provided on the outside along the display section 4*b*, 5*b*, 6*b*.

The symbol icon 4*a*, 5*a*, 6*a* is a fixedly-shaped mark, and the current value display section 4*b*, 5*b*, 6*b* is configured so that a plurality of liquid crystal segments are arranged in an arcuate form, by which the liquid crystal segments of the number corresponding to the current measurement value (remaining fuel amount, water temperature, oil temperature) are displayed by coloring.

On the other hand, the control panel section 8 of the indicator 1 is provided, as one example of key input means, an upper arrow mark key 82, a lower arrow mark key 83, a left arrow mark key 81, a right arrow mark key 84, a menu key 85, a set key 86, an OK key 87, a cancel key 88, and the like.

Also, in a lower end portion of the indicator body, a cover body 9 is provided so as to be opened and closed freely via a hinge portion, and covers and protects the control panel section 8 when the control panel section 8 is not in use.

Such a configuration corresponds to the configuration of the indicator shown in Japanese Patent Application No. 2003-99485.

[Camera Section]

The monitoring camera section C consists of, for example, a CCD camera. In the example shown in the figures, the camera section C is constructed so that a camera body (housing) 62 is provided on a supporting shaft 63 of a mounting base 61 so that the angle is adjustable in the up-and-down direction and the right-and-left direction.

[Camera Control Unit]

In this example, the camera section C is provided with a camera control unit 65 for changing the camera posture such as the photographing direction of the camera section C or performing zooming in and out by controlling the focusing mechanism of camera.

This control of the camera section may be the control of both of camera posture and focusing function or may be either one of the two. Also, the change of camera posture is not limited to a change in the up-and-down direction and the right-and-left direction, and the camera posture may be changed in one direction only. In addition, the camera section may be configured so that various functions are controllable.

In this example, the camera control unit 65 can change the photographing direction by changing the posture of the camera body 62 in the up-and-down direction and the right-and-left direction via an actuator.

Also, the camera control unit 65 can zoom in and out a zoom lens by controlling the focusing function of the camera section C.

One or a plurality of camera sections C can be mounted at appropriate locations according to the work content of the hydraulic excavator 20.

[Camera Control Input Means]

Also, in this example, the indicator 1 is provided with a camera control input means for sending a control signal to the camera control unit 65.

As one example, the camera control input means uses the arrow mark keys 81 to 84 shown in FIG. 4. By pressing the menu key 85, the functions of the arrow mark keys are made in a camera control mode, and by pressing the left or right arrow mark key 81 or 84 once, the photographing angle of the camera section C can be changed by a predetermined angle.

Also, by pressing the upper arrow mark key 82, the zoom lens is zoomed in, and by pressing the lower arrow mark key 83, the zoom lens is zoomed out.

Further, by pressing the cancel key 88, the posture of the camera section C is returned to its initial position.

This combination can be set freely.

For example, the configuration may be such that by pressing the upper or lower arrow mark key 82 or 83 once, the photographing angle of the camera section C can be changed up or down by a predetermined angle.

In the above-described example, the existing keys are used as the camera control input means. However, a special-purpose switch (or key) for camera control may be provided on the indicator 1.

Figure 5:
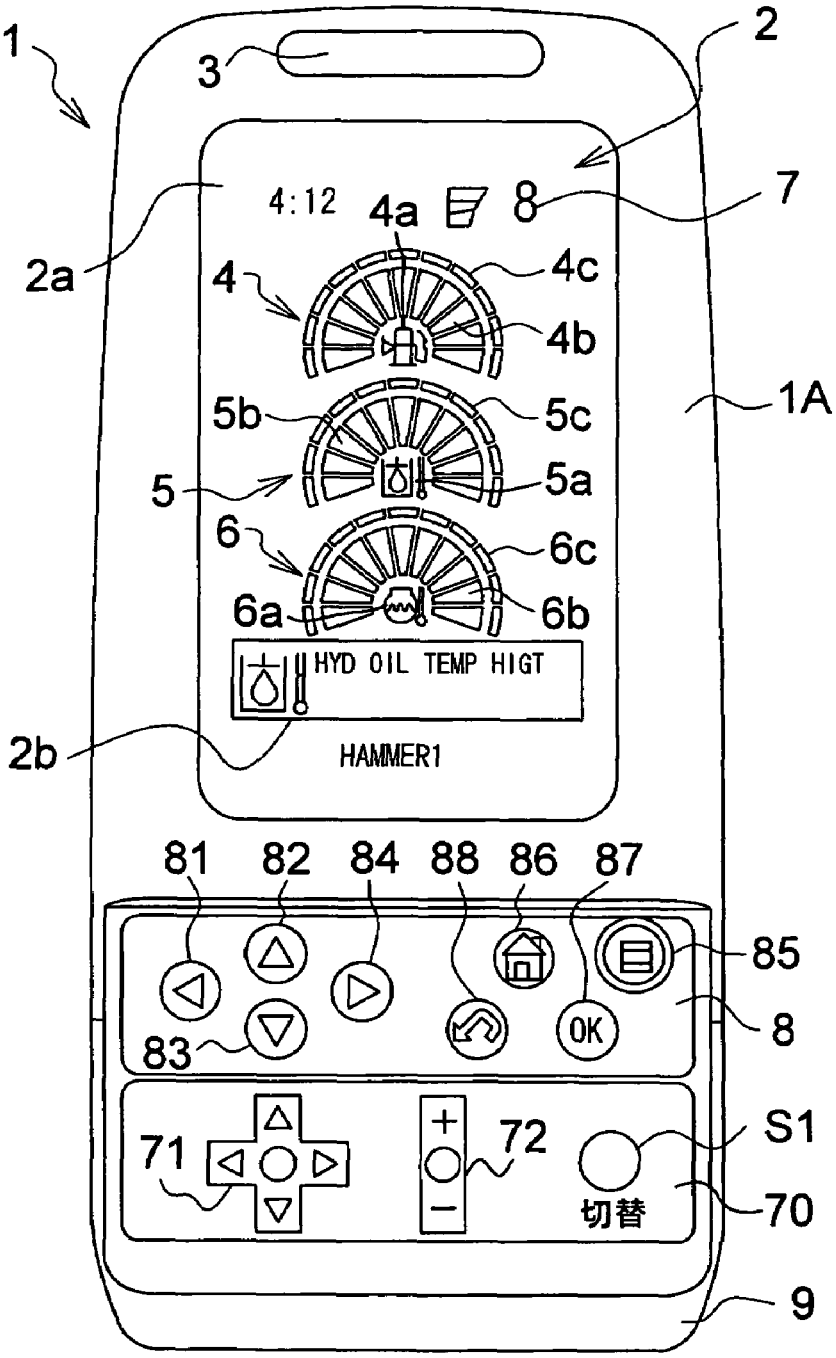
FIG. 5 is a front view of a different indicator provided with a camera control input section.

In FIG. 5, a camera control input section 70 is provided adjacently to the control panel section 8. A cross-shaped key 71 corresponding to the upper, lower, left, and right arrow mark keys is provided so that the photographing angle can be changed in the up-and-down direction and the right-and-left direction by the operation of this key 71.

Also, a zoom key 72 is provided. The focusing mechanism of the camera section C is controlled so that the zoom lens is zoomed in by pressing the +mark and it is zoomed out by pressing the −mark.

As this key or switch, a publicly known configuration such as a single-function key or joystick can be used. The design of the key or switch can be changed appropriately according to the application and function as a camera control interface function.

Reference character S1 denotes a screen selector switch for switching the current display mode, described later.

[Mounting Location of Camera Section]

One example of mounting locations of the camera section C is shown in FIG. 2. As exemplarily shown in FIG. 2, the camera sections C are arranged at C1 on the tip end side of the arm 29 and C2 at an intermediate position of the boom 27 to monitor the front, at C3 in front of the lower end of the upper swinging body 22 to monitor the side, at C4 in an upper part at the rear of the cab 24 and C5 in an upper part of a counterweight to monitor the rear, and at the like positions. In FIG. 2, a location indicated by a circle mark shows the location at which the camera section is mounted, and the direction indicated by an arrow mark shows the photographing direction. In the present invention, the mounting position of the camera section is not subject to any special restriction, and the number of camera sections mounted at one location is not limited to one, and a plurality of camera sections can be mounted at one location.

Thus, the position in a blind spot of operator and the work state of work attachment can be caught by the camera section, and the photographing area can be controlled as necessary.

The camera section C may be in a state in which the switch is always turned on or may be controlled so that the switch is turned on manually or automatically by a predetermined equipment operation of the operator.

The image data photographed by this camera section C is sent to an image input section of the indicator 1 via the input switching means 14 by a wire system or a wireless system.

[Alarm Judging Means]

The alarm judging means 11 converts the detection data from the sensor group S, S, S . . . into a measurement value. Alternatively, in the case where the measurement value can be obtained directly from the sensor, the alarm judging means 11 receives the measurement value as it is, and compares it with preset alarm standard data, thereby judging whether or not an alarm is necessary.

The measurement value subjected to the judgement is converted into the gage image shown on the monitor section 2 or the alarm image by the image processing means 12, or an event display, described later, shown on the event section 2*b* is called out and is shown as the image data.

[Alarm Control Means]

The alarm control means 13 receives the result of the alarm judging means 11 and the current display mode of the input switching means 14, described later, and determines the presence or absence of activation of the alarm section 3 and the alarm pattern in the case of activation.

[Input Switching Means]

The input switching means 14 for the input to the monitor section 2 selectively performs switching between a measurement display mode sent from the image processing means and a camera display mode sent from the camera section, and displays one selected display mode on the monitor section.

As the switching mechanism therefor, there are available a manual switching system in which the current display mode is switched by manual operation of operator, an automatic switching system in which the current display mode switches automatically in association with the operation of predetermined equipment, and an automatic switching system in which the current display mode switches automatically when it is judged, by the alarm judging means, that the display of alarm screen is necessary.

In this example, as the switching system, only any one system may be used, or a system combining any two systems or all of the systems may be used.

In the case of the manual switching system, the screen selector switch provided, for example, on the indicator 1 is used.

The screen selector switch may be a special-purpose switch or key S1 (indicated by a dashed line in FIG. 4). Alternatively, a switching function may be given to the existing key (for example, the set key 86) so that by pressing this key, a switching signal is sent to activate the switching mechanism, by which the current display mode on the monitor section 2 is switched.

In the case of the automatic switching system, when a preset control lever performs a predetermined operation, the switching signal is sent based on the detection signal of a sensor, not shown, by which the switching mechanism is activated and hence the current display mode is switched.

The predetermined operation of control lever for activating the switching mechanism may be set by the teaching system in which the operation is set freely (registered in the memory) in advance according to the taste of the user (or the operator) or the use conditions at the time of work, or may be set in the same manner by the selection from the preset operation patterns of the predetermined equipment that has been preset.

In this example, as exemplarily shown in FIG. 3, in the case where the camera section C is arranged to monitor the rear of construction machine (for example, C4, C5, etc.), the current display mode on the monitor section 2 is switched to the camera display mode by the retreat operation of running control levers 35, and is switched to the measurement value display mode by the advance operation thereof.

In the case where the camera section C is arranged to monitor the side of construction machine (for example, C3 etc.), the current display mode on the monitor section 2 is switched to the camera display mode by the swirl operation of the control levers 35 (simultaneous operation of advance and retreat of the paired running levers), and is switched to the measurement value display mode by the straight forward movement operation of advance or retreat thereof.

In the case where the camera section C is arranged to monitor the front of construction machine (for example, C1, C2, etc.), the current display mode on the monitor section 2 is switched to the camera display mode by the operation of a work equipment control lever 36 for boom, arm, or bucket, and is switched to the measurement value display mode by the operation for work finish and running.

The kind of the display mode selected by the input switching means 14 is fed back to the alarm control means 13.

These operation members are not limited to the control levers 35 and 36. The display mode may be switched by detecting the operation of a running foot pedal 37 or the operation of a lock lever 38.

Also, the display mode may be switched in the case where a plurality of operations are combined or in the case where a combination of operations using a plurality of operation members is performed.

[Event Display and Alarm Pattern]

In this example, a different alarm pattern is generated between the case where the display mode of the indicator 1 is the measurement value display mode and the case where it is the camera display mode.

As one example, in the case of the measurement value display mode, the alarm pattern is a pattern in which the LED is turned on and off in one second cycle, and in the case of the camera display mode, the alarm pattern consists of four kinds of (1) turned on, (2) turned on and off in 0.5 second cycle, (3) turned on and off in 1 second cycle, and (4) turned on and off in 2 second cycle.

Thereupon, the alarm patterns in each mode according to the event display are exemplarily shown below.

(1) In the case where it is detected that the level of hydraulic oil becomes lower than a predetermined value or in the case where the temperature of hydraulic oil increases exceeding a predetermined value.

(a) In the measurement value display mode, the background of the event display section 2*b* assumes a red color, and an icon corresponding thereto and characters "HYD LEVEL LOW" and characters "HYD TEMP HIGH" are displayed on the background. Together with this display, the alarm section 3 generates an alarm of turning on and off in 1 second cycle.

(b) In the camera display mode, the monitor section 2 still displays the camera display mode (no display on the event display section 2*b*), and the alarm section 3 continues to turn on.

(2) In the case where abnormality of battery voltage is detected.

(a) In the measurement value display mode, the background of the event display section 2*b* assumes a red color, and an icon corresponding thereto and characters "BATTERY VOLTAGE IRREGULAR" are displayed on the background, but the alarm section 3 is still turned off.

(b) In the camera display mode, the monitor section 2 still displays the camera display mode, and the alarm section 3 turns on and off in 0.5 second cycle.

(3) In the case where it is detected that the level of fuel becomes lower than a predetermined value.

(a) In the measurement value display mode, the background of the event display section 2*b* assumes an orange color, and an icon corresponding thereto and characters "FUEL LEVEL LOW" are displayed on the background, but the alarm section 3 is still turned off.

(b) In the camera display mode, the monitor section 2 still displays the camera display mode, and the alarm section 3 turns on and off in 1 second cycle.

(4) In the case where it is detected that the supply of lubricating oil starts.

(a) In the measurement value display mode, the background of the event display section 2*b* assumes a green color, and an icon corresponding thereto and characters "LUBE STARTING" are displayed on the background, but the alarm section 3 is still turned off.

(b) In the camera display mode, the monitor section 2 still displays the camera display mode, and the alarm section 3 turns on and off in 2 second cycle.

As described above, the alarm pattern of the alarm section 3 can be displayed by being changed between the measurement value display mode and the camera display mode according to the situation of equipment. Therefore, even if the monitor section 2 displays the camera display mode, the operator becomes aware of the alarm, and hence can take measures, for example, can switch the display mode to the measurement value display mode to know abnormality well in advance.

In the above-described example, the case where the alarm pattern is changed between the measurement value display mode and the camera display mode based on the same alarm standard is shown. However, the alarm standard itself may be set separately in the measurement value display mode and the camera display mode.

Also, in the above-described example, whether or not the alarm is necessary is judged from the measurement value of the object to be monitored that can be displayed on the indicator 1. However, whether or not the alarm is necessary may be judged on the basis of the measurement value of an object not to be displayed on the indicator, and an alarm may be generated.

Example 2

Also, in the above-described example, the configuration in which whether or not the alarm is necessary is not judged from the data of the camera section C is exemplarily shown. However, the configuration may be such that whether or not the alarm is necessary is judged based on the data of the camera section C.

The configuration may be such that, for example, during the work, the camera section C is allowed to be activated always or during predetermined work, and when an obstacle is detected in a predetermined monitoring area displayed on the camera section C, whether or not the alarm is necessary is judged by a camera alarm judging means 11', and an alarm is generated in the same way.

Figure 6:
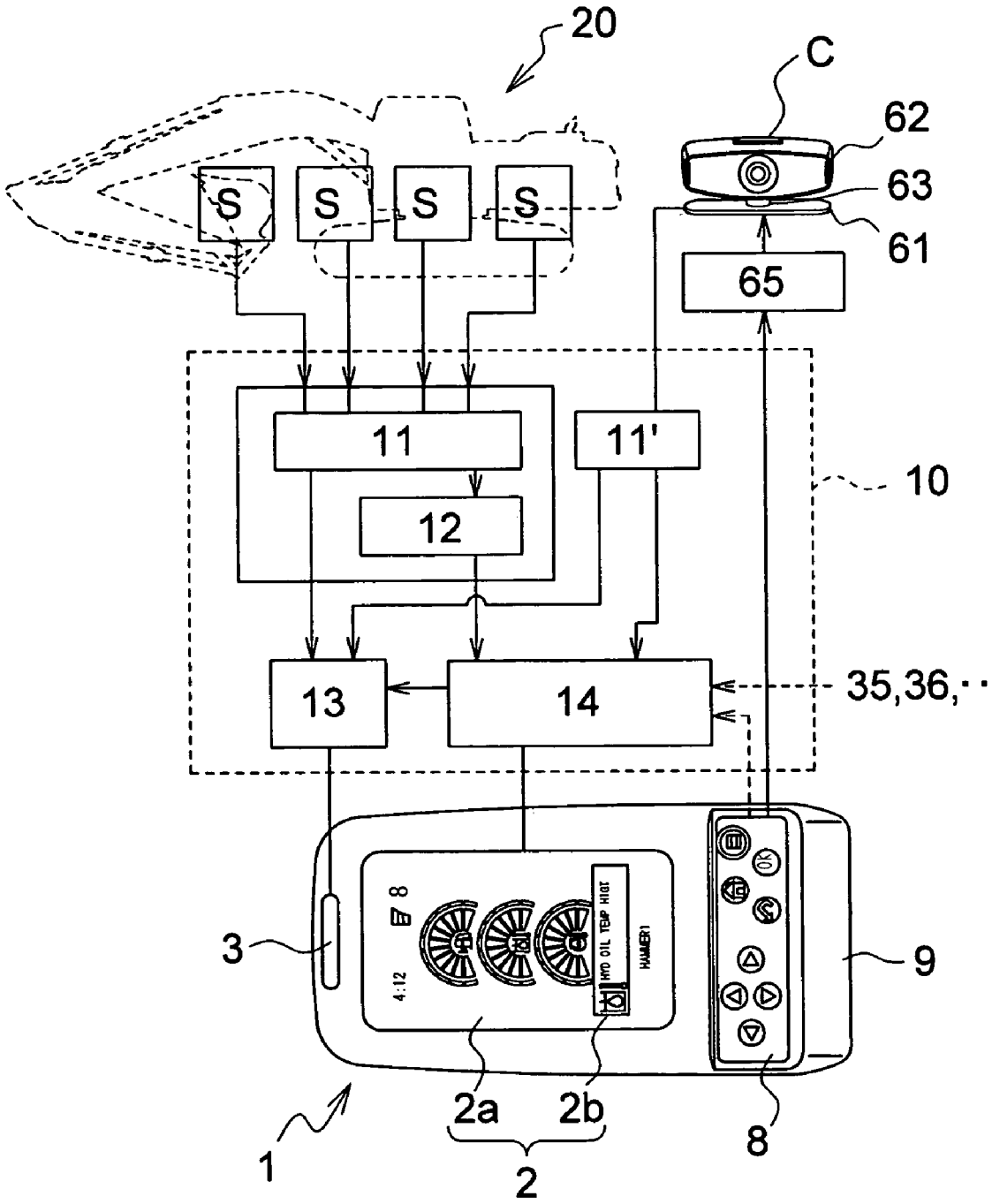
FIG. 6 is a block diagram of another indicator control system with a camera section, which is provided with a camera alarm judging means.

In the indicator control system with a camera section shown in FIG. 6, the image data of the camera section C is sent to the camera alarm judging means 11', and it is judged whether or not the obstacle displayed on the image data is safe.

When it is judged that an alarm is necessary, the data is sent to the alarm control means 13 and controls the alarm section 3, by which an alarm is generated with a predetermined alarm pattern.

In this case as well, the alarm pattern can be made different between the case where the monitor section 2 is in the camera display mode and the case where it is in the measurement value display mode.

Also, in the case where the monitor section 2 is in the measurement value display mode, a message such as "OBSTACLE IS PRESENT IN SWIRL AREA" may be displayed on the event display section 2*b*.

Other configurations are the same as those of the above-described first example, so that the explanation thereof is omitted.

In the above-described examples, the configuration in which the alarm section consists of an alarm lamp has been shown. However, the configuration may be such that a voice alarm is generated or a voice alarm is generated together with the alarm lamp.

Also, in the above-described examples, as the camera control input means, the manual input using the input means such as the predetermined switch provided on the indicator has been shown exemplarily. However, the configuration may be such that the whole or a part of the camera control input means generates a camera control signal automatically by means of the detection of a previously registered operation of a predetermined operation member, by which the direction of camera or the focusing mechanism is controlled.

In addition, it is a matter of course that various design changes can be made without departing from the spirit and scope of the present invention.

INDUSTRIAL APPLICABILITY

In the above-described examples, the hydraulic excavator is exemplarily shown as one example of construction machine. However, the present invention can be applied to a construction machine having any other work attachment, such as a wheel loader or a bulldozer.

The invention claimed is:

1. An indicator control system with a camera section comprising: an indicator for selectively switching, by an input switching means, from a measurement value display mode for showing measurement data of an object of a construction machine to a camera display mode of a camera section mounted on the construction machine and vice versa and for displaying a selected mode on a monitor section; an alarm section for generating an alarm, which is provided at a place different from the monitor section on the indicator; an alarm judging means for judging whether or not measurement data of the object to be monitored corresponds to a predetermined alarm standard; and an alarm control means for activating the alarm section when the alarm judging means judges that the alarm is necessary; wherein the alarm control means preliminarily sets, for the object to be monitored which it is judged an alarm is necessary for, different alarm patterns between the measurement value display mode and the camera display mode; wherein the monitor section displays an image data indicative of an alarm and the alarm section displays a predetermined alarm pattern by means of blinking or sound when the monitor section is in the measurement value display mode; and wherein the monitor section keeps a camera display mode and the alarm section displays an alarm pattern by means of blinking or sound which is different from that of the alarm pattern displayed in the measurement value display mode when the monitor section is in the camera display mode.

2. The indicator control system with the camera section as claimed in claim 1: wherein the switching means consists of manual switching using an input means such as a predetermined switch provided near an operator's seat or on an indicator; wherein the camera section is provided with a camera control unit which can control the functions such as a photographing direction and a focus of a camera; and wherein the indicator is integrally provided with a control panel section including upper, lower, left, and right arrow mark keys as key input means; and wherein the functions of the arrow mark keys are switched to a camera control mode to control the photographing direction and the focus of the camera through the camera control unit by means of the inputs of the arrow mark keys.

3. The indicator control system with the camera section as claimed in claim 1: wherein the switching means consists of automatic switching effected by detection of a previously registered operation of a predetermined operation member; wherein the camera section is provided with a camera control unit which can control functions such as a photographing direction and a focus of a camera; and wherein the indicator is integrally provided with a control panel section including upper, lower, left, and right arrow mark keys as key input means; and wherein the functions of the arrow mark keys are switched to a camera control mode to control the photographing direction and the focus of the camera through the camera control unit by means of the inputs of the arrow mark keys.

4. The indicator control system with the camera section as claimed in claim 1: wherein the switching means consists of a switching means that performs switching automatically when an indicator alarm judging means judges that display of an alarm screen is necessary; wherein the camera section is provided with a camera control unit which can control functions such as a photographing direction and a focus of a camera; and wherein the indicator is integrally provided with a control panel section including upper, lower, left, and right arrow mark keys as key input means; and wherein the functions of the arrow mark keys are switched to a camera control mode to control the photographing direction and the focus of the camera through the camera control unit by means of the inputs of the arrow mark keys.

5. The indicator control system with the camera section as claimed in claim 1: wherein the switching means consists of manual switching using an input means such as a predetermined switch provided near an operator's seat or on an indicator, automatic switching effected by detection of a previously registered operation of a predetermined operation member, and automatic switching effected when an indicator alarm judging means judges that display of an alarm screen is necessary; wherein the camera section is provided with a camera control unit which can control the functions such as a photographing direction or a focus of a camera; and wherein the indicator is provided with a camera control input means for sending a controlling signal to the camera control unit.

6. The indicator control system with a camera section according to claim 1, characterized in that the camera section can be attached to a desired position of the construction machine; when the camera section is arranged to monitor a rear of the construction machine, a current display mode on the monitor section is switched by detection of operation of a running operation member; when the camera section is arranged to monitor a side of the construction machine, a current display mode on the monitor section is switched by detection of operation of a swirl operation member; and when the camera section is arranged to monitor a front of the construction machine, a current display mode on the monitor section is switched by detection of operation of an operation member for boom, arm, or bucket.

7. The indicator control system with a camera section according to claim 1, characterized in that detection of a kind of the operation member serving as the switching means and a combination of operations can be changeably registered in memory.

8. The indicator control system with a camera section according to claim 1, characterized in that the camera section is provided with a camera control unit which changes a camera posture such as a photographing direction of the camera section and controls a focusing mechanism for a zoom lens of a camera; and the indicator is provided with a camera control input means for sending a control signal to the camera control unit.

9. The indicator control system with a camera section according to claim 8, characterized in that the camera control input means consists of manual input using an input means such as a predetermined switch provided on the indicator.

10. The indicator control system with a camera section according to claim 8, characterized in that the camera control input means consists of automatic input effected by detection of a previously registered operation of a predetermined operation member carried out by the whole or a part of the camera control input means.

* * * * *